US006988965B2

(12) United States Patent
Krause

(10) Patent No.: US 6,988,965 B2
(45) Date of Patent: Jan. 24, 2006

(54) PLAYER SHAPED PRACTICE PAD

(75) Inventor: Harry W. Krause, Lake Wylie, SC (US)

(73) Assignee: Rae Crowther Company, Rock Hill, SC (US)

( * ) Notice: Subject to any disclaimer, the term of this patent is extended or adjusted under 35 U.S.C. 154(b) by 91 days.

(21) Appl. No.: 10/767,951

(22) Filed: Jan. 29, 2004

(65) Prior Publication Data

US 2005/0170918 A1 Aug. 4, 2005

(51) Int. Cl.
*A63B 69/34* (2006.01)

(52) U.S. Cl. ..... 473/445; 473/441; D21/788

(58) Field of Classification Search ..... 473/441, 473/440, 439, 422, 445; D21/788
See application file for complete search history.

(56) References Cited

U.S. PATENT DOCUMENTS 2,967,709 A 1/1961 Stahley
3,216,724 A * 11/1965 Williams ..... 473/445
3,236,101 A * 2/1966 Lemonick ..... 73/379.05
3,326,553 A 6/1967 Forrest
3,827,690 A * 8/1974 Rogers ..... 473/445
3,907,291 A * 9/1975 Parker ..... 473/445
5,013,039 A * 5/1991 Cole ..... 473/445
5,385,523 A * 1/1995 Forrest ..... 473/445
6,261,194 B1 * 7/2001 Hadar et al. ..... 473/441
6,599,206 B1 * 7/2003 Forrest et al. ..... 473/441
2002/0147061 A1 10/2002 Krause et al.

* cited by examiner

*Primary Examiner*—Stephen Blau

*Assistant Examiner*—M. Chambers
(74) *Attorney, Agent, or Firm*—Charles L. Schwab; Nexsen Pruet, LLC

(57) ABSTRACT

A football practice device having pads in the shape of a player with feet on the ground and leaning forward with bend knees. The device is preferably a sled having S-shaped pads with a resilient synthetic core in which an S-shaped steel support is centrally embedded.

12 Claims, 4 Drawing Sheets

11
12
13
16
17
18
19
21
22
23
24
26
27
28
29
31
32
36
37

PLAYER SHAPED PRACTICE PAD

BACKGROUND OF THE INVENTION

A variety of training accessories have been used to improve the skill of football players. Blocking sleds with padded dummies are commonly used to train down lineman in proper blocking technique. There is a need for a training device which more closely approximates actual playing conditions.

SUMMARY OF THE INVENTION

The football training device of this invention provides an S-shaped pad shaped like a football player in a striking position. At the snap of the ball the lineman accelerates out of this forward leaning, bent knee striking position. This is the position a football player takes to leverage the opposing player. A player using the training device of this invention learns how to crouch and strike an opponent who is in this typical blocking position. The time between when a player accelerates from his stance, but is not standing up, is the critical position and timing for successful blocking and tackling. The player shaped dummy helps teach a player to use his hands and shoulders to block upwardly on the opposing player's body thereby destroying the opposing players traction and balance. The player shaped practice equipment helps players to understand the need to strike their opponents on the rise, to engage their chests and lift them. It also helps to train defensive players in separation and pass drills, in "bull rushing", "swimming" and "ripping the pads".

BRIEF DESCRIPTION OF THE DRAWINGS

The invention is illustrated by the accompanying drawings in which.

DETAILED DESCRIPTION OF THE INVENTION

Figures 1, 2:
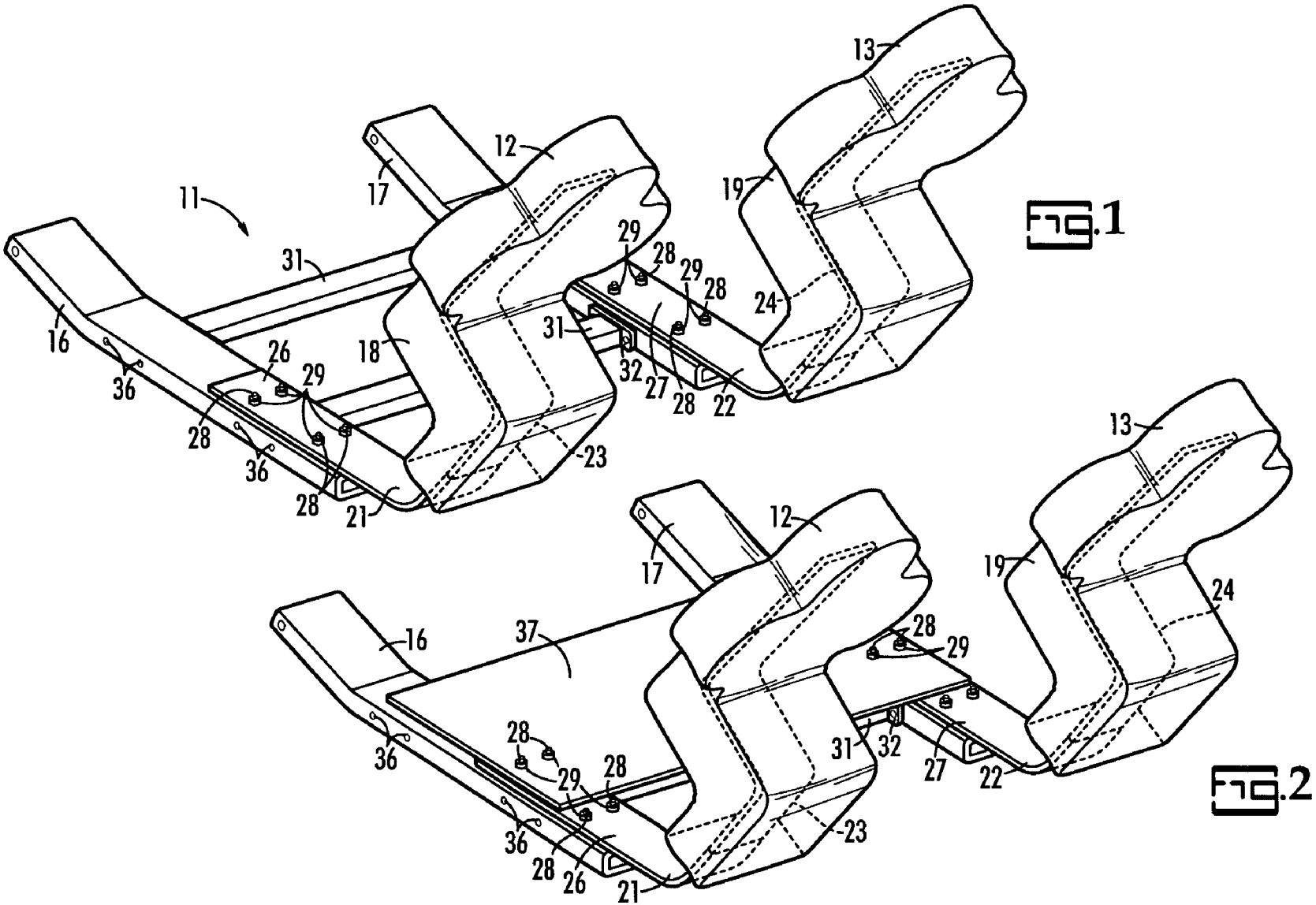
FIG. 1 is a perspective view of a blocking sled with two player shaped dummies.
FIG. 2 is a view similar to FIG. 1 with a coach's platform on the sled.
Figure 6:
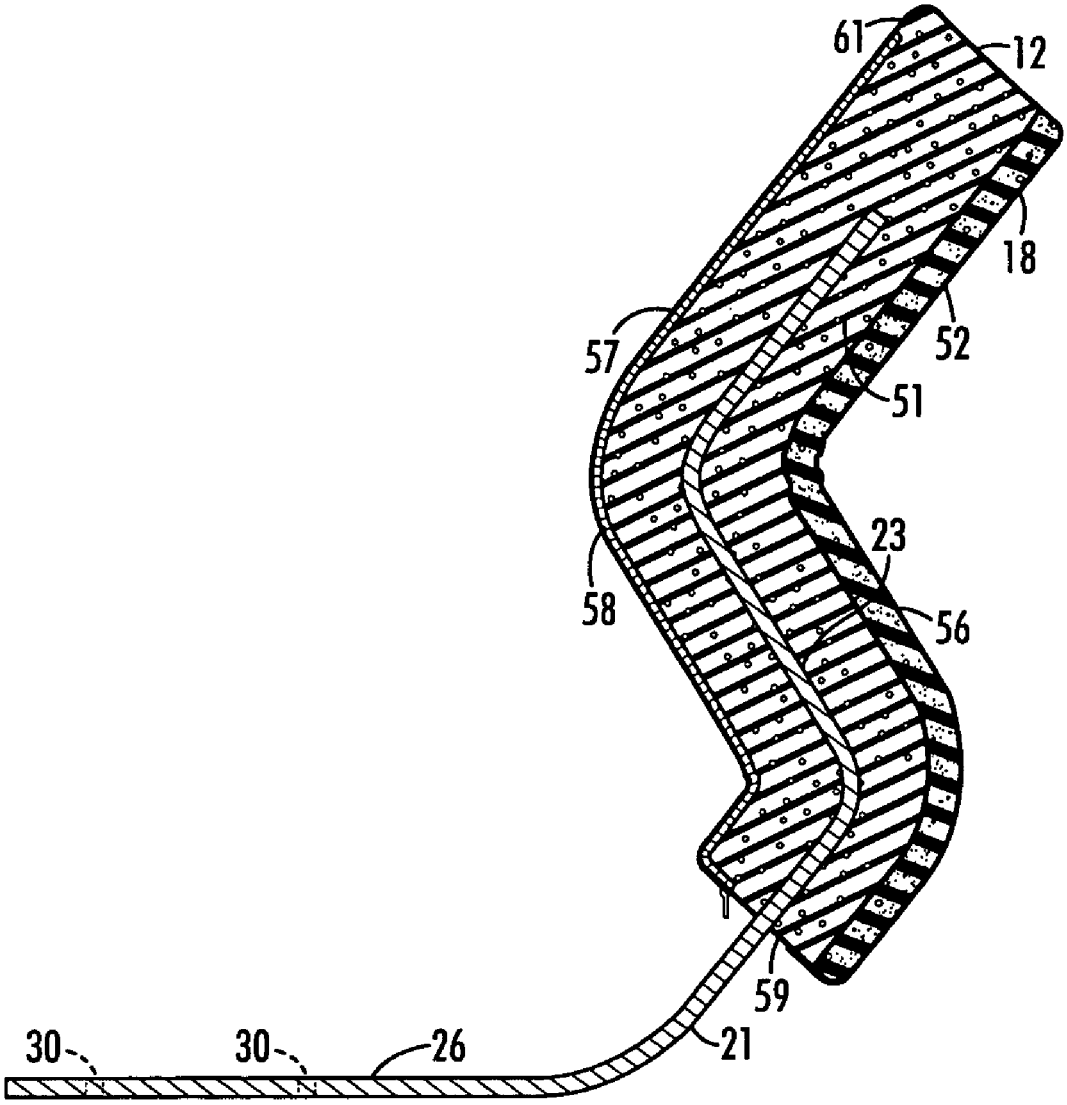
FIG. 6 is a section taken on line VI—VI in FIG. 5.

A two dummy training sled 11 shown in FIG. 1 includes a pair of dummy modules 12, 13 secured to the front ends of a ground engaging support in the form of a pair of parallel ground engaging runners 16, 17, which curve upwardly from the ground 15 at their rear ends. The dummy modules 12, 13 include body shaped pads 18, 19 mounted on steel supports 21, 22 having S-shaped portions 23, 24 centrally embedded in the pads 18, 19, respectively, and having bottom parts in form of rearwardly extending horizontal portions 26, 27. The horizontal portions 26, 27 are releasably secured to the runners 16, 17 by threaded studs 28 on the runners 16, 17 and nuts 29. The studs 28 extend upwardly through openings 30 in the portions 26, 27, two of which openings 30 are shown in FIG. 6. The runners 16, 17 are rigidly secured to one another by transverse cross braces 31 having end brackets secured to the confronting lateral sides of the runners 16, 17 by releasable fasteners in the form of cap screws 32 in threaded engagement with threaded openings 36 in the sides of the runners 16, 17. The dummy modules 12, 13 can be removed from the sled 11 for indoor storage by removing the cap screws 32.

FIG. 2 shows the training sled of FIG. 1 with a coach's platform 37 releasably attached thereto by releasable fasteners in the form of studs 28 and nuts 29.

Figure 3:
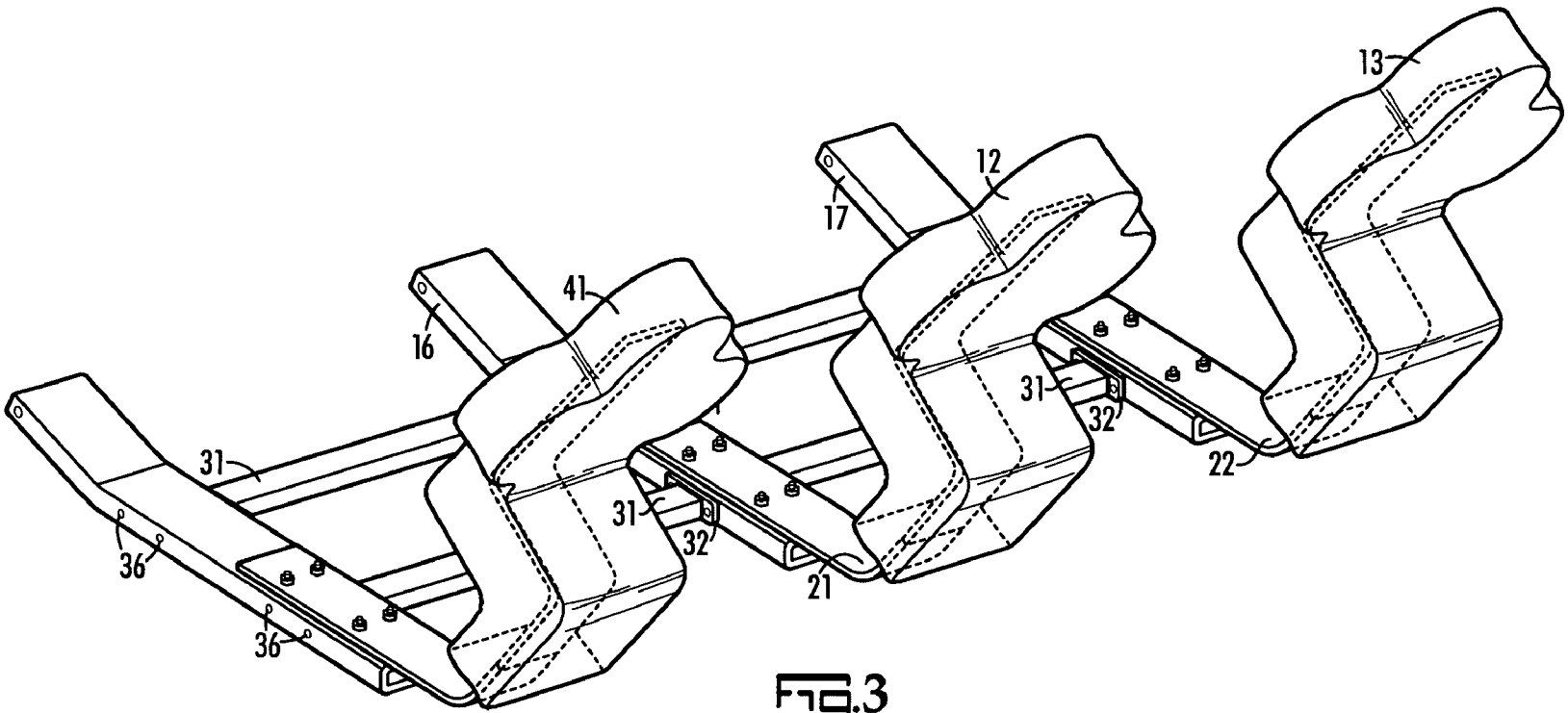
FIG. 3 is a perspective view of a sled having 3 dummies.

FIG. 3 shows an additional dummy module 41 secured to dummy module 12 by a pair of parallel transverse braces 31. The modular design of the training device permits additional dummy modules to be added and permits dummy modules to be removed thus allowing the coaches to increase or decrease the number of players being trained while providing appropriate resistance to movement upon impact.

Figure 4:
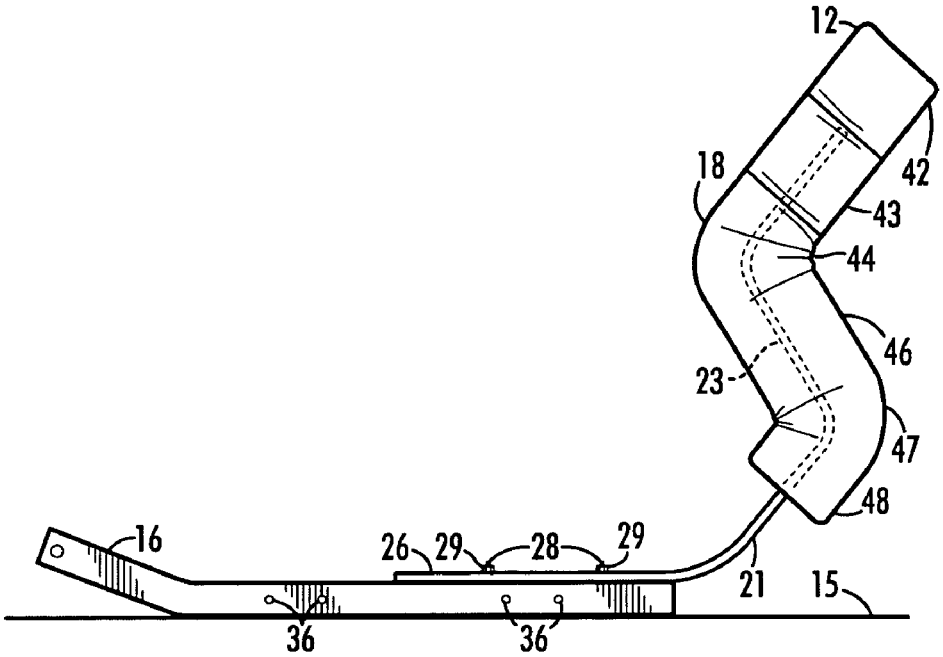
FIG. 4 is a side view of the sled shown in FIG. 1.
Figure 5:
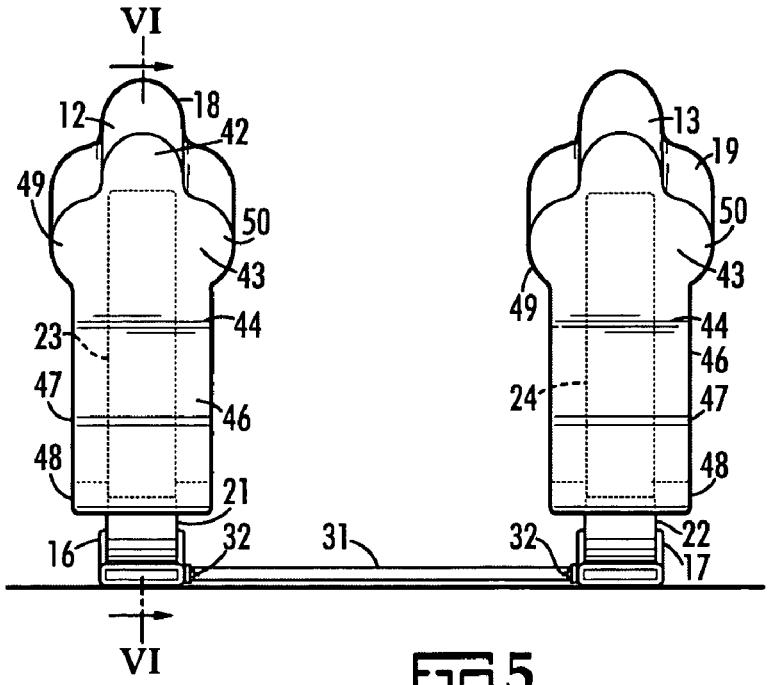
FIG. 5 is a front view of the sled shown in FIG. 1.

FIG. 4 shows the S configuration of the pad 18 and the S-shaped portion 23 of the steel support 21. The support 21 is formed from a band of steel having a predetermined resilience. The pad 18 includes a head portion 42, a shoulder and chest portion 43, a waist portion 44, an upper leg or thigh portion 46, a knee portion 47 and a lower leg portion 48. Thus the pad 18 resembles the lower legs, thighs and torso of an opposing player with feet on the ground and in a forwardly inclined position with knees bent. The part of the pad 18 above the waist portion 44 extends forwardly at the 45 degree angle to the supporting ground 15, the thigh portion 46 slopes rearwardly to a 40 degree angle to the ground 15 and the lower leg portion 48 slopes forwardly to an angle of approximately 60 degrees to the ground 15. As shown in FIG. 5 the shoulder parts 49, 50 of the shoulder and chest portion 43 extend laterally outward from the remainder of the body shaped pad 18. Thus, during practice blocking the training player is afforded a chest area and an arm pit contact area against which he can impose a hand and shoulder lifting thrust to destabilize his opponent. The front to rear thickness of the pad 18 is dimensioned to emulate the front to rear depth of a padded adult football player. By providing a dummy with the before mentioned proportions and with the S-shaped portion 23 of the steel support 21 centrally embedded in the pad 18, a practicing football player is afforded a realistic padded dummy for frontal or side contact without direct, or near direct, contact with any metal support structure. The lower end of the S-shaped portion 23 of the steel support 21 extends from the lower end of the S-shaped core 51 and is secured to the sled 11 by the horizontal connection portion 26. There are no other connections between the sled 11 and the pad 18 and there are no protrusions from the pad 18 or connecting apparatus that might give rise to an injury to a player.

The body shaped pad 18 of module 12, shown in section in FIG. 6, includes an S-shaped inner core 51 of relatively stiff open cell synthetic foam surrounding and bonded to the S-shaped portion 23 of the steel support 21. The open cell synthetic foam of the core 51 is preferably open cell polyurethane foam having a density of 1.8 pounds per cubic feet and a compression indention load deflection rating of 80. The pad 18 also includes an outer layer 52 on the front of the pad which is approximately 2 inches in thickness. The outer layer 52 is a soft synthetic foam shock absorbing material bonded to the front side of the inner core 51. The soft synthetic material is preferably a polyurethane open cell foam having a density of 1.4 pounds per cubic foot and a compression indention load deflection rating of 40. Thus the S-shaped portion 23 of the steel support 21 and the relatively stiff resilient inner core 51 function in the manner of the bones and the bone position controlling muscles of a human body and the relatively soft outer layer 52 provides cushioning similar to the football pads and the fat tissue of a human body. The body shaped pad 18 is covered by a removable cover 56 made of a durable woven fabric. The cover 56 includes a bottom opening type zipper 57 on its rear side 58 permitting the pad to be enclosed in covers of different colors and decor and permitting replacement as needed. The zipper 57 extends from an opening 59 in the bottom of the cover 56 to a point 61 near the top of the cover 56.

This invention provides a football lineman training device which has pads shaped like an opposing lineman in his initial set, striking position in which knees are bent and he is crouched in a forward leaning position. This pad is instrumental in teaching a lineman proper position and timing for effective blocking to destabilize the opposing defensive or offensive player to open up the opposing line for a running play, prevent access to the quarterback during a passing down or to penetrate the opposing line when on defense. This pad teaches a player how to apply upward thrust to an opposing player. The player in training must crouch low enough to apply an upward thrust to the S-shaped dummy pad which is shaped to emulate an opposing defensive or offensive lineman. The training device is reasonable in cost and is made in modular form so that identical components can be used to provide the desired number of pads. The individual dummy modules 12, 13, 41 can be removed for seasonal storage and the removable covers 56 can be replaced in the event they become worn or damaged.

What is claimed is:

1. A football player practice device comprising:

a ground engaging sled having a pair of laterally spaced fore and aft extending ground engaging runners and braces rigidly interconnecting said runners, said sled having a forward end, a pair of laterally spaced padded dummy modules secured to said forward end of said sled in laterally spaced relation to one another, each of said dummy modules including an S-shaped pad with an S-shaped resilient elastomeric core, said pad resembling a football player with feet on the ground in an forwardly inclined position with knees bent and including lower leg portions, thigh portions, waist portion, chest and shoulder portion and head portion and a steel support having a horizontal portion secured to the forward end of said sled and an S-shaped portion centrally embedded in said S-shaped resilient core.

2. The practice device of claim 1 wherein said chest and shoulder portion slopes forwardly at an angle to the ground of not more than 60 degrees.

3. The practice device of claim 1 wherein said rearwardly extending portions of said steel supports are secured, respectively, to said ground engaging runners.

4. The practice device of claim 3 wherein each of said dummy modules includes a front layer of soft resilient material on the front of said resilient core.

5. The practice device of claim 4 wherein said inner core and said front layer are resilient open cell synthetic foam and wherein said front layer is substantially softer than said inner core.

6. A football player practice dummy comprising:

a steel support having a horizontally extending bottom part adapted for rigid connection to a ground engaging support and an upwardly extending S-shaped part emulating the lower legs, thighs and torso of a football player leaning forward with knees bent, a pad having an inner S-shaped core of stiff open cell synthetic foam encompassing and bonded to said S-shaped part of said steel support so as to centrally embed said S-shaped part of said support in said S-shaped core, said S-shaped core presenting front and rear sides, laterally opposite sides and top, said S-shaped core emulating the lower legs, the thighs, the torso and the head of a football player leaning forward with knees bent, an outer layer of soft open cell synthetic foam bonded to said front side of said core and a removable cover in the shape of said pad enclosing the top and sides of said pad.

7. The football practice dummy of claim 6 wherein said synthetic foam is polyurethane foam.

8. The football practice dummy of claim 7 wherein said stiff open cell polyurethane foam has a density of at least 1.8 pounds per cubic foot and a compression indentation load deflection rating of at least 80 and wherein said soft open cell polyurethane foam has a density not more than 1.4 pounds per cubic foot and a compression indention load deflection hardness rating of no more than 40.

9. The football practice dummy of claim 6 wherein said cover has a rear side, a front side and an opening at its bottom through which said steel support extends when said cover is installed on said pad and wherein said cover includes a zipper at said rear side of said cover, extending upwardly from said opening; said zipper, when opened, permitting removal of said cover.

10. The football player practice dummy of claim 6 having a ground engaging sled to which said horizontally extending bottom part of said steel support is rigidly secured.

11. The football player practice dummy of claim 6 wherein said torso emulating part of said S-shaped core includes a shoulder and chest portion having shoulder parts which extend laterally outward from the remainder of the pad.

12. A football player practice device comprising:

a ground engaging sled, a dummy module including an S-shaped pad with an S-shaped elastomeric core, said pad resembling a football player with feet on the ground in an forwardly inclined position with knees bent and including lower leg portions, thigh portions, waist portion, chest and shoulder portion and head portion and a steel support having a connection portion secured to said sled and an S-shaped portion centrally embedded in said S-shaped resilient core, said S-shaped portion of said steel support having a lower end extending downwardly from the lower end of said S-shaped elastomeric core to said connection portion.

* * * * *